US006059290A

United States Patent [19]

Neil

[11] Patent Number: 6,059,290

[45] Date of Patent: May 9, 2000

[54] BOARD GAME

[76] Inventor: Douglas Murphy Neil, 11 Middlehouse Court, Carluke, South Lanarkshire ML8 5UH, United Kingdom

[21] Appl. No.: 09/074,686

[22] Filed: May 8, 1998

[30] Foreign Application Priority Data

May 8, 1997 [GB] United Kingdom ..... 9709430

[51] Int. Cl.[7] ..... A63F 3/00; A63F 9/18

[52] U.S. Cl. ..... 273/243; 273/141 R; 273/249; 273/287; 273/282.1; 273/431

[58] Field of Search ..... 273/141 R, 141 A, 273/299, 287, 282.1, 429–432, 138.1, 249, 243, 242

[56] References Cited

U.S. PATENT DOCUMENTS

| | | | |
|---|---|---|---|
| 1,540,288 | 6/1925 | Schallis | 273/141 R |
| 2,339,351 | 1/1944 | Myers | 273/141 R |
| 2,462,507 | 2/1949 | Klyver | 273/141 R |
| 2,587,242 | 2/1952 | Stringer | 273/141 R |
| 2,608,410 | 8/1952 | Klyver | 273/141 R |
| 3,117,790 | 1/1964 | White | 273/141 R |

FOREIGN PATENT DOCUMENTS

| | | |
|---|---|---|
| 378833 | 8/1932 | United Kingdom . |
| 849841 | 9/1960 | United Kingdom . |

*Primary Examiner*—Benjamin H. Layno
*Attorney, Agent, or Firm*—Lalos & Keegan

[57] ABSTRACT

Apparatus (5) for playing a game which comprises a spindle (35), a playing surface, a spinner arm (25) rotably depending from the spindle and a rotatable body (80) at or near an end of the spinner arm. In use the rotatable body is contactable with the playing surface such that the body and arm are rotatable across the playing surface. In one arrangement the spinner arm is an elongate member (60) of a transparent plastic material, such as PMMA, which at a first end is mounted to the spindle (35) with the rotatable body (80) at or near it's second end. Also the playing surface may include a base board (10), a playing template (15) and a cover member (20).

10 Claims, 3 Drawing Sheets

BOARD GAME

SUMMARY OF THE INVENTION

The present invention relates to games and more particularly, although not exclusively, to an apparatus primarily intended for a game to be played by two or more participants. A method of playing the game is also disclosed.

According to a first aspect of the present invention there is provided an apparatus for playing a game comprising a spindle, a playing surface and a spinner arm rotatably depending from the spindle.

Preferably the spinner arm depends at or near a first end thereof from the spindle.

Preferably a rotatable body is provided at or near a second end of the spinner arm, the body being contactable with the playing surface, such that the arm is rotatable across the playing surface.

The rotatable body may be a wheel.

A rotational axis of the rotatable body may be parallel to/coincident with the spinner arm.

The spindle may be provided on a base board.

The apparatus may further comprise a playing template.

The playing surface may be in the form of a cover member which, in use, is placed atop the playing template which template is placed atop the base board.

Additionally there may be provided a plurality of playing tokens, a plurality of coloured playing pegs, and a plurality of question cards.

Preferably the playing template is provided with a central hole within which the base board spindle locates.

In a preferred embodiment the playing template is substantially circular and is divided by means of radial and concentric circular markings into a plurality of segments.

Preferably the circular and radial markings serve to divide the playing template into five concentric rings, each ring being subdivided into twenty four segments.

Preferably also the cover member may be provided with a central hole within which the base board locates.

The cover member may be manufactured from a substantially transparent plastics material such as polymethyl methacrylate (perspex™).

Alternatively the playing template and cover member may be combined by, for example, etching the playing template on the underside of the transparent cover member.

The spinner arm assembly may comprise an elongate member provided at a first end with a hole within which the base board spindle may locate, and provided at a second end with at least one wheel.

The spinner arm elongate member may be manufactured from a substantially transparent plastics material such as polymethyl methacrylate (perspex™).

The at least one wheel may rotatable about an axis parallel to a longitudinal axis of the elongate member and passing through the hole in the first end thereof.

The spinner arm elongate member may be provided with a plurality of holes within which the playing pegs may be located, said holes being provided in one or more distinct groups.

The spinner arm elongate member may be marked so as to divide it into four sections, each section being radially displaced from the first end such that, in use, the individual sections correspond with the innermost four of the concentric rings provided upon the playing template.

The plurality of holes may be divided equally between the four sections.

In a preferred embodiment there may be provided six holes within each section.

The spinner arm assembly may be provided with indicator means, such as an arrow, to aid in identifying the position of the spinner arm assembly relative to the playing template.

According to second aspect of the present invention there is provided a method of playing a game comprising:

providing apparatus comprising a spindle, a playing surface and a spinner arm depending at or near a first end thereof from the spindle;

electing a player or team of players to commence playing the game, the remaining player(s) or team(s) of players following the elected player or team of players in a predetermined sequence;

each player or team of players according to the rules of the game rotating the spinner arm through at least 360° such that the finishing position of the spinner arm and/or playing pieces provided upon the spinner arm correspond to locations marked upon the playing surface;

in accordance with the rules of the game, following instructions presented upon said marked locations; and repeating steps 3 and 4 above until a player or team of players is deemed to have won the game.

According to a third aspect of the present invention there is provided a method of playing a game employing an apparatus according to the first aspect of the invention comprising:

electing a player or team of players to commence playing the game, the remaining player(s) or team(s) of players following the elected player or team of players in a predetermined sequence;

each player or team of players according to the rules of the game rotating the spinner arm through at least 360° such that the finishing position of the spinner arm and/or playing pieces provided upon the spinner arm correspond to locations marked upon the playing surface;

in accordance with the rules of the game following instructions presented upon said marked locations; and repeating steps 2 and 3 above until a player or team of players is deemed to have won the game.

An embodiment of the present invention will now be described with reference to the following drawings:

DETAILED DESCRIPTION OF THE PREFERRED EMBODIMENT

Figure 1:
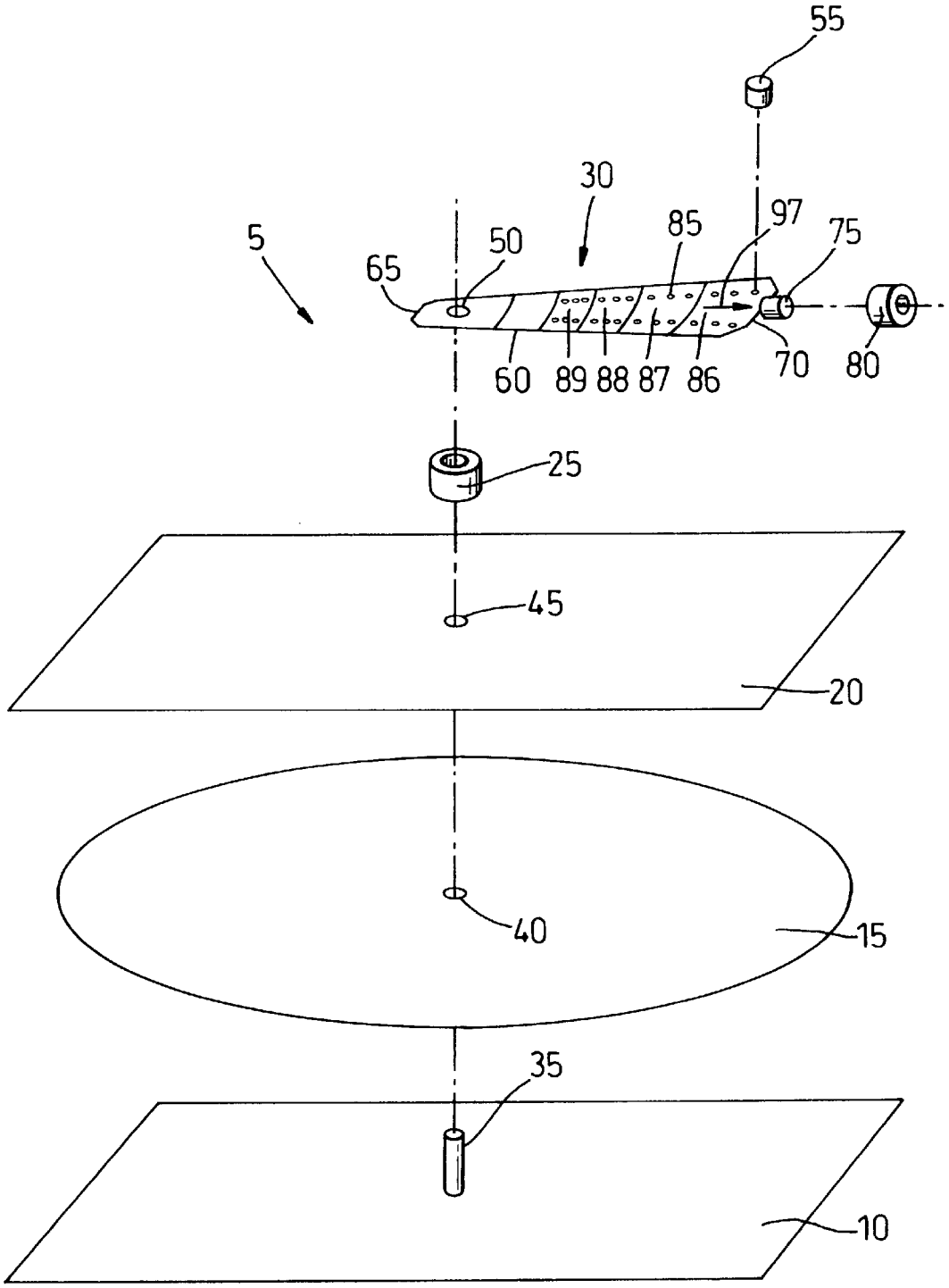
FIG. 1 an exploded perspective view of an embodiment of an apparatus for playing the game in accordance with the present invention.
Figure 2:
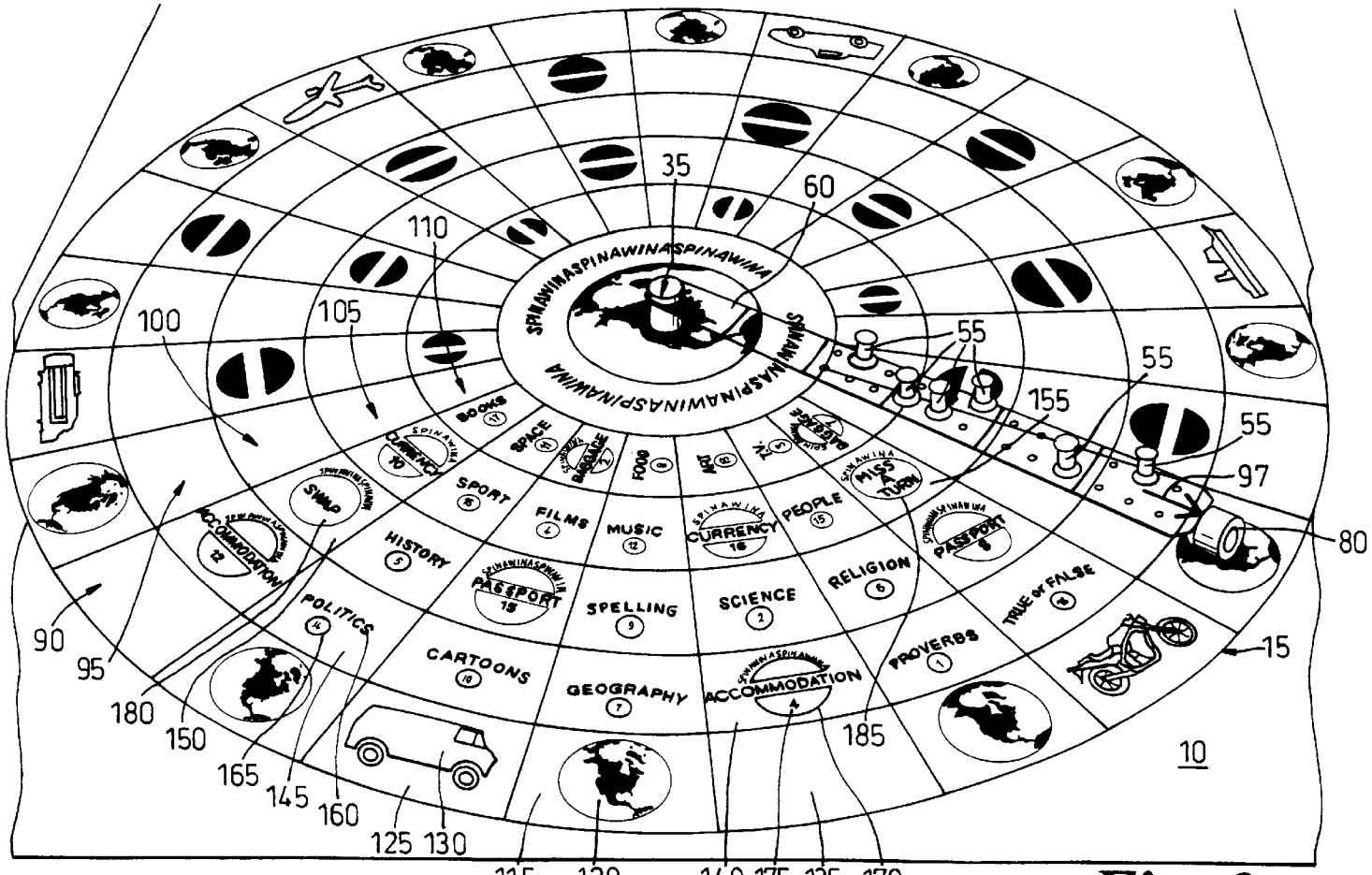
FIG. 2 a perspective view of the apparatus shown in FIG. 1 in an assembled form.

Referring firstly to FIGS. 1 and 2 there is shown apparatus 5 for playing a game for up to six players/teams comprising a base board 10, a playing template 15, a cover member 20, a spacer member 25, and a spinner arm assembly 30. The base board 10 is provided with a central spindle 35 which projects upwardly therefrom. The playing template 15, cover member 20 and spinner arm assembly 30 are provided with holes 40, 45, 50 within which the central spindle 35 may locate when the apparatus 5 is assembled.

Additionally there provided six playing pegs 55 which may be differently coloured to differentiate them from one another e.g. black, white, red, blue, green and yellow, twenty four playing tokens (not shown), and a plurality of question cards conveniently contained in one or more boxes (not shown).

The cover member 20 is manufactured from a transparent material such as polymethyl methacrylate (perspex™) thus enabling the playing template 15 retained below to be viewed and enabling the spinner arm assembly to rotate freely. The playing template 15 is marked as hereinafter described in the description.

The spinner arm assembly 30 comprises an elongate member 60 with, at a first end 65, a hole 50 within which the central spindle 35 may locate. At a second end 70 is provided an axle 75 upon which is mounted a freely rotatable wheel 80. The elongate member 60 is further provided with a plurality of holes 85 which, in the embodiment shown, are divided into four groups 86, 87, 88, 89 of six The groups 86, 87, 88, 89 of holes 85 are spaced such that, in use, they correspond with concentric rings 95, 100, 105, 110 marked upon the playing template 15. During the game the playing pegs 55 may be located in the holes 85 in accordance with the rules as shown in FIG. 2. The elongate member 60 may be manufactured from a transparent material such as polymethyl methacrylate (perspex™) thus enabling the playing template 15 below to be viewed, and enabling the spinner arm assembly to rotate freely. The elongate member 60 is marked near the second 70 with an arrow 97.

In use, the hole 65 of the spinner arm assembly 30 is located upon the central spindle 35 while the wheel 80 rests upon the cover member 20. The spacer member 25 ensures that the spinner arm assembly 30 is provided substantially parallel to the base board 10, playing template 15 and cover member 20. The spinner arm assembly 30 may be rotated relative to the central spindle 35 in accordance with the rules of the game described hereinafter. The spinner arm assembly 30 may be caused to rotate as the result of a force applied to it by one of the players of the game, for example, by hand.

Figure 3:
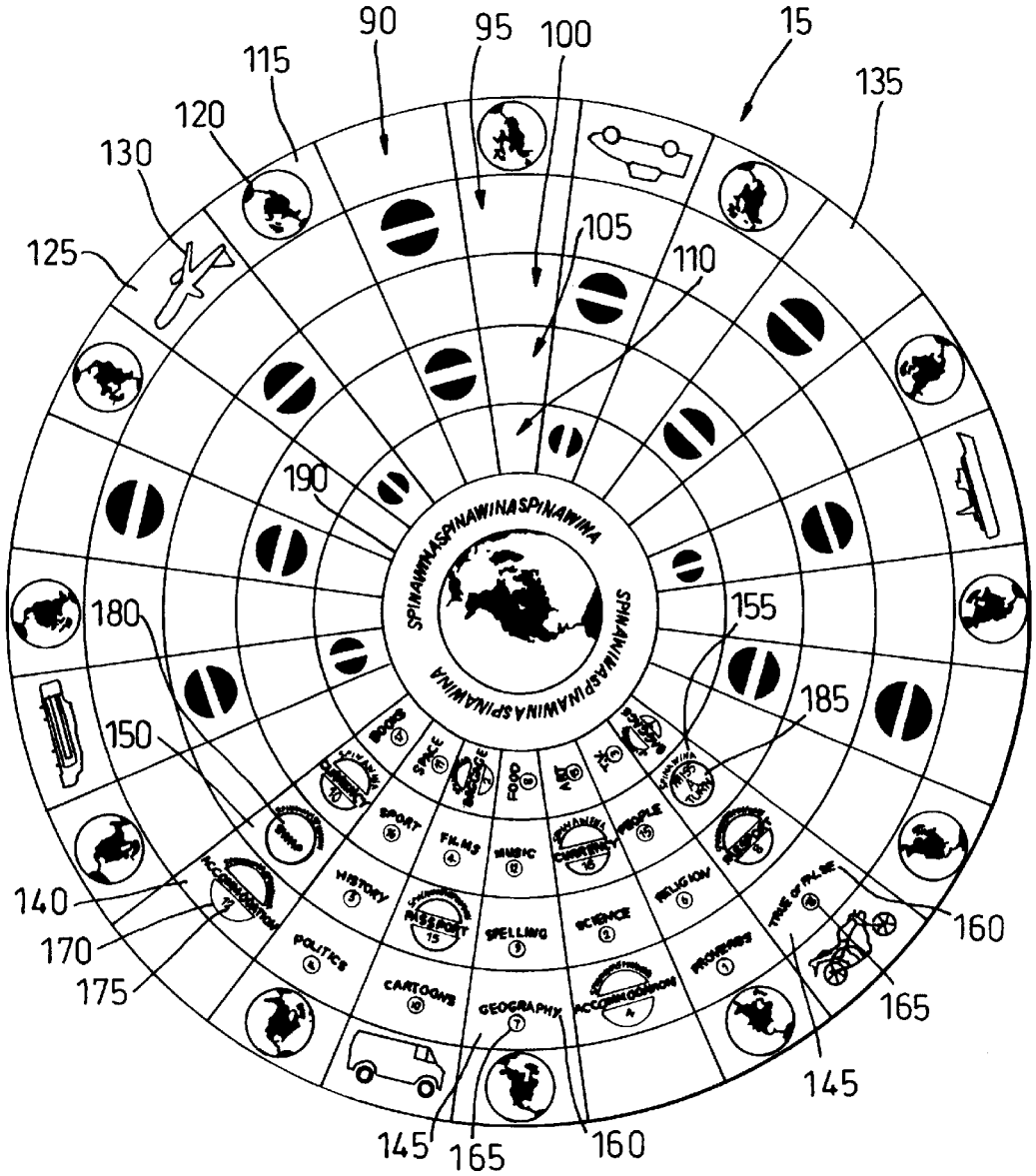
FIG. 3 a plan view of a playing template in for use in an apparatus according to the present invention.

Referring now to FIGS. 2 and 3 there is shown a playing template 15 in accordance with an embodiment of the present invention. The template 15 shown may be used to play a board game with a travel theme. The template 15 is substantially circular and is divided both concentrically and radially such that there are provided five rings 90, 95, 100, 105, 10 each comprising twenty four segments. The rings 90, 95, 100, 105, 110 may be differently coloured to differentiate them from one another.

The outermost ring 90 has twelve segments 115 marked with images of the planet Earth 120, six segments 125 with images of various modes of transport 130, namely van, motorcycle, ship, automobile, aircraft and train, and six blank segments 135. The transport modes 130 may be coloured so as t correspond with the colours of the playing pegs 55. The segments 115, 125, 135 are arranged as shown in the following repeating pattern: planet earth 115-blank 135-planet earth 115-transport mode 125.

The remaining ninety six segments of inner four rings 95, 100, 105, 110 are marked as either token segments 140, question segments 145, swap segments 150 or miss a turn segments 155. The question segments 145 are marked with a question category 160 and a number within a circle 165 corresponding to that category. Question categories 160 and difficulty may be chosen according to the theme of the game i.e. travel, sport, music etc and the age group of the intended participants. In the embodiment shown sixty six segments are marked as question segments 145 and the following question categories may be: proverbs, television, films, history, geography, spelling, cartoons, music, art, people, sport, true or false, science, religion, food, space, politics, and books.

In the embodiment shown the twenty four token segments 140 are marked with a pair of semi circles 170 and each ring 95, 100, 105, 110 is provided with six equidistantly spaced token segments 140. In keeping with the travel theme of the embodiment of the game shown the token segments 140 are marked between the semi circles 170 with the words "Accommodation , "Passport", "currency" or "Baggage". All of the accommodation marked token segments 140 are provided on the outermost 95 of the inner four rings 95, 100, 105, 110 with each of the remaining three types of token segment 140 (passport, currency and baggage) likewise provided on the innermost three segments 100, 105, 110. The token segments 140 are further marked with a number 175 corresponding to a question category 160. The semi circles 170 used to define the token segments 140 may be coloured red.

In addition to the question 145 and token segments 140 there are provided in the embodiment shown four swap segments 150, one for each of the four inner rings 95, 100, 105, 110, and two miss a turn segments 155. The swap segments 150 are marked with a circle 180 containing the word "Swap". The swap segment circles 180 may be coloured yellow to differentiate them from other types of segment. The miss a turn segments 155 are marked with a circle 185 containing the words "Miss A Turn". The miss a turn segment circles 185 may be coloured green to differentiate them from other types of segment.

The twenty four playing tokens (not shown) are substantially disc shaped and are marked on an upper face with either the words "Accommodation", "Passport", "Currency", or "Baggage", and on a lower face each with a number corresponding to a question category. In the embodiment shown for a game for up to six players/teams there are provided six each of token marked accommodation, passport, currency and baggage.

The game may be played by up to six players/teams substantially as hereinafter described.

OBJECT OF THE GAME

The winner is the player or team of players who first travels to the centre 190 of the board 10, 15, 20 from the outermost ring 90, via the spinner arm assembly 30, by correctly answering questions and collecting four playing tokens on route.

START OF PLAY

Each player/team selects a coloured playing peg 55 and places it on the correspondingly coloured transport mode segment 130. All twenty four playing tokens are displayed face upwards near the board. Each player/team selects a playing token and the player/team with the lowest number displayed on the rear of their playing token starts the game. If more than one player/team selects the same lowest number, then these players/teams select another playing token until only one has the lowest number. All the playing tokens are then shuffled and returned face upwards. Play continues in a clockwise direction around the board 10, 15, 20.

THE SPINNER

The spinner arm assembly 30 is rotated, in either direction, by each player/team in turn. The spinner arm assembly 30 must complete a full revolution otherwise the player/team should spin again until this is achieved. If the arrow 87 on the spinner arm assembly 30 stops directly between segments then the spinner arm assembly 30 is rotated again until a distinct segment is identified. In order to achieve a placing on the outermost group 86 of holes 85 on the spinner arm assembly 30 with a playing peg 55, each player/team is required to land on an Earth segment 115 on the outer ring 90 with their first attempt. Each player/team must continue in turn until this is achieved.

QUESTION SEGMENTS

Each segment on the board is allocated a number. The numbers represent various question categories e.g., 16=Sport and 7=Geography. These numbers and categories correspond with questions and answers on the question cards.

CONTINUATION OF PLAY

Immediately upon placing their playing peg 55 in the outermost group 86 of holes 85 upon the spinner arm assembly 30 a player/team proceeds with another spin. The player/team is required to answer correctly the numbered category questions, sited below their playing peg 55, from the question cards (read out by an opposing player/team) and, if the question is answered correctly, is entitled to another spin, otherwise play is continued by the next player/team. On landing on a token segment 140, correctly answering the appropriate question entitles the player/team to proceed to the next inner group of holes 87, 88, 89 on the spinner arm assembly 30. At this point the player/team chooses an appropriate playing token corresponding to the category marked upon the token segment 140 and must not expose the number on the reverse. The player/team is rewarded with another spin.

WINNING THE GAME

Having successfully collected all four categories of playing token en route and moved their playing peg 55 to the innermost group 89 of holes 85, a player/team selects one of their playing tokens and turns it over to reveal the number on the reverse. The player/team must answer a question corresponding to that category number to win the game. If the question is answered wrongly, the token is discarded and play continues with the next player/team. When the turn of play passes back to the player/team who failed to answer the winning question correctly, one of the three remaining playing tokens is turned over and the numbered question attempted as before. Each player/team, therefore, has only four opportunities to win the game. When a player/team runs out of playing tokens without winning the game, that player/team can decide then to retire from the game or restart at the beginning.

SWAP

If a player/team lands on a swap segment 150, the player/team must exchange their playing peg 55 on the spinner arm assembly 30 with another player's/team's playing peg 55 of their choice. Having swapped places, the relative playing token or tokens must be exchanged also. This might be to the player's /team's advantage or disadvantage, depending on their forced swap on the spinner arm assembly 30. Obviously, if all players/teams are on the same group 86, 87, 88, 89 of holes 85 on the spinner arm assembly 30, then play continues with the next player/team without any action.

QUESTIONS

The question box or boxes is/are divided into 2 sections and 2 players from opposing sides are appointed before start of play to read out the questions. The cards are selected from the front of the box and discarded to the rear as play continues. The correct answers are always divulged after wrong answers are given.

It is envisaged that the apparatus described above may be adapted and the playing life of the game played therewith may be extended by the purchase of additional playing templates 15, playing tokens and question cards.

In addition to the original game, additional playing templates 15 would be available as separate purchase packs. These additional packs would comprise:

A Playing template (folded to accommodate packaging) to suit a favoured sport or team, for example:

| | |
|---|---|
| Soccer | Manchester United Football Club |
| Football | N.F.L. New York Giants. |
| Basketball | N.B.C. Chicago Bulls. |
| Ice-Hockey | N.H.L. Pittsburgh Penguins. |
| Athletics | Olympics. |
| Golf | World Majors. |
| Tennis | Grand slams. |
| Motor Racing | Grand Prix. |

Playing Tokens (to suit the above themes) i.e. for soccer

6 Programme, Ticket, Snacks, Scarf.

Question Cards

1 Pack containing approx. 150 questions relative to the chosen theme.

How the additional template works

The additional template is placed over the original playing template 15 and the game is played all as previously described. The additional template will have 6 specialist question segments without numbers relative to the particular theme of the template, i.e., questions on Manchester United Football Club, therefor 6 question segments will disappear which were on the original template i.e., 3 Religion and 3 Food. The box containing the specialist questions is placed adjacent to the original pack and used when the players/teams playing peg 55 on the spinner arm assembly 30 is positioned over a Manchester United Football Club sector.

When a player/team lands on a Manchester United Football Club segment, since there are no numbers on these segments, the player/team spins again to determine which numbered category question they should answer on the specialist question cards. At this point, if they land on a Swap or Miss a Turn sector, then these appropriate rules apply as previously described.

The embodiment of the invention hereinbefore described is given by way of example only, and is not meant to limit the scope of the invention in any way.

What is claimed is:

1. A game apparatus comprising a spindle, a playing surface marked and divided into a plurality of concentric rings, a spinner arm having an elongate member marked and divided into a plurality of sections, each section corresponding to a concentric ring, said spinner arm also having a plurality of holes within each section, and a rotatable body, the spinner arm having a first end depending from the spindle, and the spinner arm having a second end having a rotatable body, wherein the rotatable body is a wheel contactable with the playing surface.

2. Apparatus as claimed in claim 1 wherein the rotational axis of the rotatable body is coincident with the spinner arm.

3. Apparatus as claimed in claim 1, wherein the rotational axis of the rotatable body is parallel to the spinner arm.

4. Apparatus as claimed in claim 1, wherein the spindle is provided on a base board.

5. Apparatus as claimed in claim 1, wherein the spinner arm is provided at its first end with a hole within which the spindle locates.

6. Apparatus as claimed in claim 5, wherein said wheel is rotatable about an axis parallel to a longitudinal axis of the elongate member and passing through the hole in the first end thereof.

7. Apparatus as claimed in claim 5, wherein the spinner arm elongate member has four sections, each section being radially displaced from the first end such that, in use, the individual sections correspond with the concentric rings provided upon the playing surface.

8. Apparatus as claimed in claim 7, wherein the plurality of holes are divided equally between the four sections.

9. Apparatus as claimed in claim 8, wherein there are six holes within each section.

10. Apparatus as claimed in claim 1, wherein the spinner arm is provided with indicator means to aid in identifying the position of the spinner arm relative to the playing surface.

* * * * *